US005438939A

United States Patent [19]

Clarke

[11] Patent Number: 5,438,939

[45] Date of Patent: Aug. 8, 1995

[54] MANUALLY ADJUSTABLE TABLE SUPPORT SYSTEM

[76] Inventor: John P. Clarke, 211 Westway Rd., Southport, Conn. 06490

[21] Appl. No.: 797,392

[22] Filed: Nov. 25, 1991

[51] Int. Cl.[6] ..... A47B 9/00

[52] U.S. Cl. ..... 100/144; 240/188.5

[58] Field of Search ..... 108/147, 144, 145, 146, 108/148; 248/188.5, 162.1, 404, 412

[56] References Cited

U.S. PATENT DOCUMENTS

| | | | |
|---|---|---|---|
| 629,379 | 7/1899 | Lewis | 248/188.5 X |
| 2,318,458 | 5/1943 | Boren | 108/146 |
| 3,310,008 | 3/1967 | Aleska et al. | 108/146 |
| 3,311,337 | 3/1967 | Von Hagen | 248/188.5 X |
| 3,314,384 | 4/1967 | Mann et al. | 108/146 |
| 3,360,256 | 12/1967 | Kirby | 108/147 X |
| 4,502,393 | 3/1985 | Ralser | 108/146 X |
| 4,693,442 | 9/1987 | Sills | 108/144 X |

*Primary Examiner*—Jose V. Chen

[57] ABSTRACT

An adjustable, manually operated, table support system which allows the user to achieve various heights and angles of an attached surface ,while remaining seated where the surface load to the floor is distributed on four independent continuous posts. Each post is telescoping having a friction locking device attached to each. The locking devices are paired off and linked together on a actuation lever on each by a common connecting pin. This pin is in turn connected by a connecting rod to a rocker lifter situated above the two locks. Rockers of each leg unit are linked by a common actuating lever so that when force is applied to the lever both rockers rotate, lifting both connecting pins, and thus all four locks are actuated at the same time. A surface connecting system is incorporated whereby an attached surface will be allowed to rotate and slide on the telescoping posts to provide for changes of surface tilt angles.

10 Claims, 2 Drawing Sheets

MANUALLY ADJUSTABLE TABLE SUPPORT SYSTEM

This table relates to manual adjustable table support systems of the kind which allow an attached surface to achieve various heights and angles manually and can be locked in any achieveable position with one motion by the user while seated at the table without the use of expensive, pneumatic, hydraulic, electrical or other non-manual lifting devices.

Existing table support systems of this type include drafting tables, hospital over-bed tables, and other elevating work tables. More specifically, this invention applies to tables of the aforementioned type which combine one or more telescoping post members with a lever actuated friction lock as a means of controlling height of said post member. Patents, such as S. N. Mann ET AL, P. Aleska ET AL, and J. W. Boren, are typical in that they combine aforesaid features in their designs. However, while such systems incorporate a convenient single motion lock actuating lever, they depend on using no more than two posts to bear the surface load to the floor, thus having less stability than a four post table. Other tables, such as described in the patent of J. Kaiser, show a system using four telescoping posts. However, this system is dependent on using multiple levers to actuate the locking devices, thus sacrificing convenience for stability. There is currently no economically produceable four post system having the single motion locking advantage.

It is the object of this invention to provide a means for a single motion locking system to be economically incorporated into a four post manual adjustable table support system.

DESCRIPTION OF THE DRAWINGS

The invention will be more fully described with reference to the accompanying drawings in which.

DESCRIPTION OF THE PREFERRED EMBODIMENTS

Figure 1:
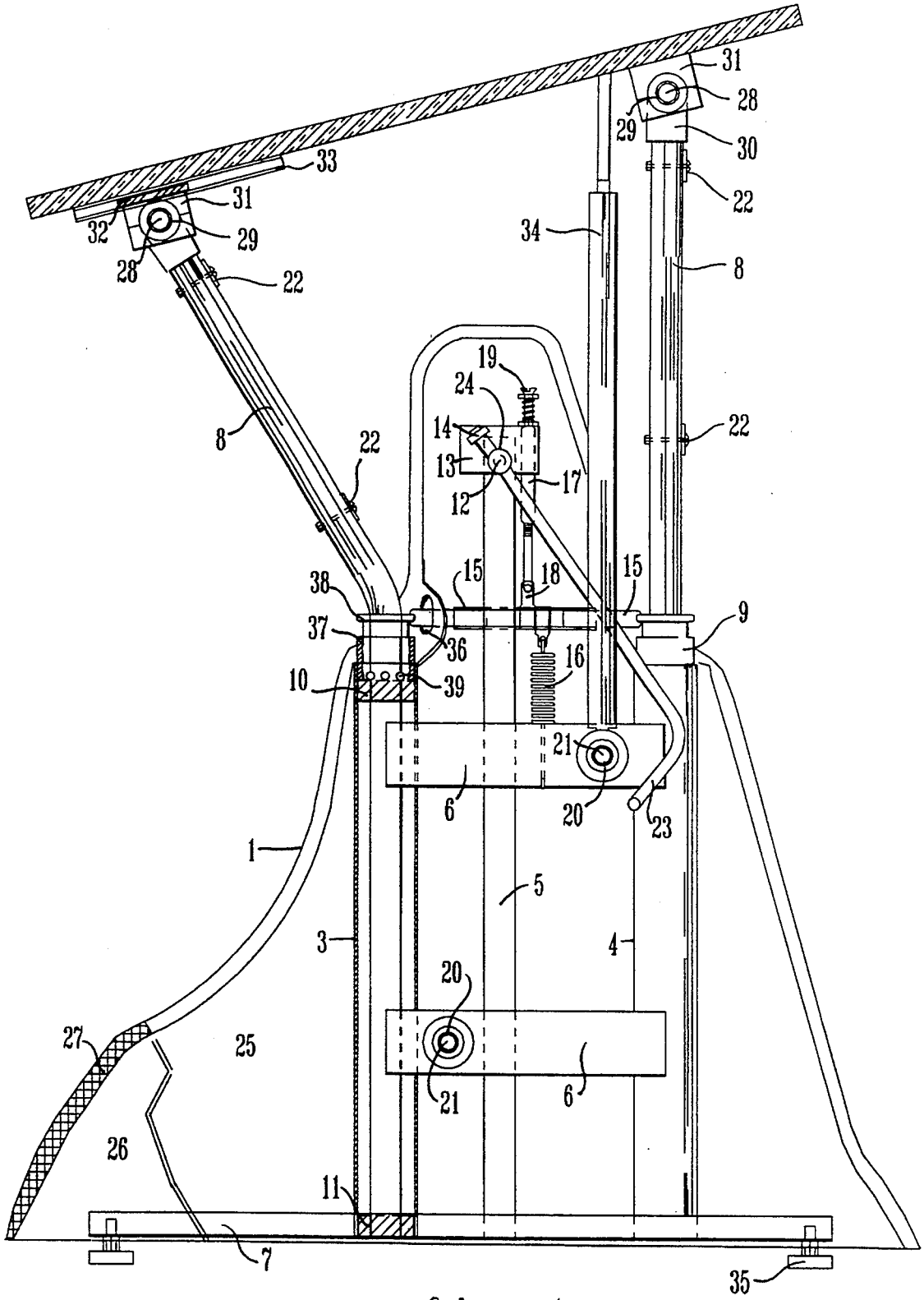
FIG. 1 shows a plan view of the left vertical support unit where the front is facing left.
Figure 2:
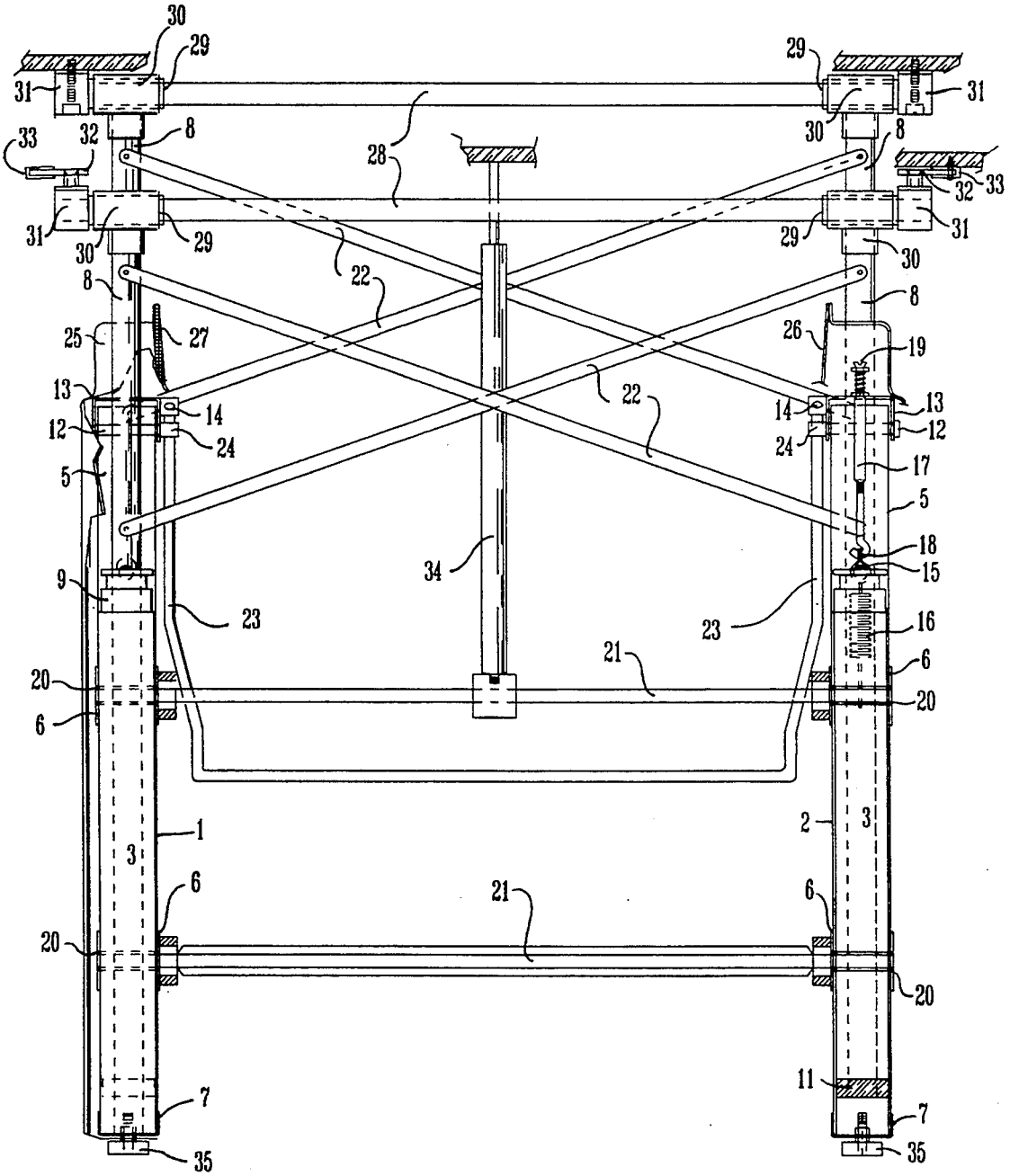
FIG. 2 shows a plan view of the front of the total adjustable vertical support system.

Referring to FIG. 1&2 an embodiment of the adjustable table support system is shown. In this embodiment, there are two separate vertical supporting leg units 1, 2. In each of these units two hollow tubes 3,4, preferably of metal, and a central support beam 5, preferably of channel metal, extend vertically apart in parallel to one another. The central support beam is positioned so that the leg side of the channel lies on the same horizontal plane extending across the back side of the two aforesaid hollow tubes 3,4. Two parallel pairs of cross-bracing plates 6 extend across and at right angles to vertical center of tubes, one pair across front and back of lower portion of tube and one pair across front and back of upper portion of tube. Cross-bracing plates are permanently affixed at contact points on ventral support beam and hollow tubes. A bottom base plate 7, preferably of metal, extends along bottom horizontal plane abutting to and permanently affixed to ends of round tubes 3,4, and central support beam 5 where the front extension of the base plate from the hollow tube is longer than the rear extension as a means for compensating for the grater leverage force that normally is on the front caused by the user resting on that portion of the table.

Extending in and protruding from each vertical tube is a tube of smaller diameter 8 where the front set of tubes are preferably bent forward as a means of more economically achieving a wider stance by avoiding the necessity of widening the whole vertical support unit. Said tubes 8 first pass through a locking device 9 which partially protrudes from the throats of tubes 3,4. The locking device is preferably of the two part sleeve type where a non-moving outer sleeve with bevelled inner surface surrounds a moving inner sleeve impregnated with steel balls such that when downward force is applied to the moving inner sleeve the steel balls are wedged between the bevelled inner surface and a suitably sized inserted tube or shaft so that ultimately downward movement of said tube or shaft ceases. A collar flange protrudes from the protruding part of the inner sleeve of the locking device which acts as a lifting lever. The smaller tube 8 then extends beyond through the locking device through a sleeve bushing 10 seated in the tube below and abutting the bottom of locking device. A donut shaped piston 11 slides over bottom of small tube 8 where outside diameter of piston and inside diameter of bushing is such that telescopic movement of the smaller tube within the larger tube can be achieved with minimal manual force while allowing minimal wobble. Pistons, locking devices, and bushings are preferably non-permanently fitted at their appropriate junctions allowing for easy assembly and future removal or repair of any of the aforesaid members. Thus it can be seen that a pair of vertical telescoping tubes, laterally connected, having a locking device on each, represents the supporting section of the vertical support unit. A friction fitted steel spindle pin 12 extends horizontally through holes in legs of channel on upper part of central support beam 5 extending to a point just beyond legs of said channel. A rocker plate 13 of channel configuration, having legs with slightly larger holes, slips over protruding ends of spindle pin 12 thus allowing plate to rock on axis of said pin. An eyelet lever 14 is affixed to and protrudes from front edge of outer face of rocker plate as a means for leveraging the rocker plate up and down on its axis.

A linking pin assembly 15 consisting of two dowel pins sliding within and protruding from opposite ends of a hollow tube of slightly larger diameter, where a compression spring lies within inner pin ends. A hole of adequate size is provided for in the central support beam 5 as to allow linking pin assembly 15 to extend from front and rear collar lifting flange. Ends of said pins are notched as to grip flange adequately during movement of lock while spring-loaded pins are constantly urged outwards as to compensate for variations caused by movement of pin assembly and locks also allowing for retraction for the removal of the locking devices. An adjustable lifting pin assembly 17 preferably of turnbuckle design where a spring-loaded adjusting screw 19 extends down through a hole of slightly larger diameter in the rear of the top of the rocker plate into a threaded body. A second screw extends from said body downward hooking into pin loop 18 that surrounds pin assembly body at the balancing point of linking pin assembly 15. The pin loop provides for an easy method of assembly and the pivoting connection required by the movement of the lifter pin assembly. By tightening or loosening the spring-loaded screw 19 the connecting pin can be raised or lowered respectively thus changing the relative angled positions of the rocker plate to lifted height of moving locking collar member thus acting as an adjusting device to synchronize movements of locking devices. A return spring 16 extends downward from the connecting pin body to the connecting loop hooking onto cross-brace plate 6 which insures positive downward locking force on the moving locking collar, cross-linking assembly, lifter assembly and rocker plate. Thus it can be seen that when a downward force is exerted on eyelet lever 14 a resulting rotational counter-clockwise motion on the rocker plate 13 is transferred to an upward movement lifting up the lifter pin assembly 17 which in turn lifts up the connecting pin assembly 15 which lifts up the moving locking collars which brings them out of the normally locked position allowing the moving telescopic tubes to move up or down. Sleeve bushings 20, preferably of metal extend through opposite holes in each pair of cross-bracing plates affixed at right angles to the vertical tubes 3,4 and parallel to each other. Cross rungs 21, preferably of solid metal rod, where ends partially extend into lower and upper set of said bushings of opposite vertical support members. Anti-sway braces 22 are affixed diagonally apart at the same corresponding points on each front and rear set of telescoping tubes in order to minimize racking lateral movement of vertical support units and to insure level simultaneous movement of both telescopic tubes in each front and rear set. An actuating lever 23, preferably of solid steel rod, extend across to link opposite rocker plates where end of said rung extend through a hole in sleeve pivot bushing 24 which in turn slips over and pivots on protruding pivot pin 12 where said actuating lever extends just beyond said bushing through eyelet lever 14 ceasing at a point just beyond. The actuating lever 23 has a "U" configuration which allows for convenient foot actuation. Thus it can be seen that by providing the common actuating linking lever to rocker plates of both vertical support units, provides a means for unlocking all four locking devices simultaneously when pushed and conversely returning all locks to the normally locked position when the lever is retracted back in its normal position. Thus it can be seen that the parallel linking of four telescopic posts has been achieved where tandem motion of front and rear sets of telescoping posts can be restricted or freed with one manual motion. A triangular shaped shell 25, preferably of molded fiberglass, encloses outside and edges of each vertical support unit. Steps in the cover shell approximately two thirds up from the bottom provide for holes required for the protrusion of the lock-in collars and telescoping posts. Vertical slots are provided for in the sides of said steps at a location that provides for lifter pin protrusion while also acting as a guide for lifter pin travel. Two holes in bottom flange of cover shell provide for protrusion of floor adjusting levelers 35 that screw into bottom plate 7. All aforesaid holes also provide for a convenient way to hold cover shell non-permanently in place for easy separation from internal leg members in the event that replacement or repair is necessary. A cover plate 26 encloses inside of each vertical support unit affixed non-permanently by snap on edging 27 which snaps over flange on outer edge of cover shell 25. Holes are provided for a cover plate at a location which provides for protrusion of bushings 20, spindle 12, and eyelet lever 14. Two horizontal connecting rungs 28 extending parallel to cross rungs 21 extend over tops of respective front and rear sets of telescoping posts 8 which are rotationally affixed to said posts by inserting connecting rungs through sleeve bushings 29 which in turn are fitted into the cross part of a tubing "T" connector 30 where the stem of said "T" is then slip fitted over end of telescoping post. The horizontal connecting rungs extend beyond the "T" into a two piece tube clamp 31 which on the rear set of telescoping tubes is affixed permanently to the underside of a surface while on the front set is affixed to the underside of a slide plate 32 which extends past the thickness of said clamp and enters partially along its outer edge into a channel-shaped track 33 affixed on the underside of a surface permanently in parallel to the vertical support units. It can be seen then that both front and rear connecting "T's" 30 allow for rotational movement of a surface on each of the front and rear connecting rungs 28 while also allowing said rungs to slide laterally forward and backward on underside of surface both functions being necessary to achieve different angles of the surface. A typical constant force gas spring 34 rests on and extends upward from the upper lateral rung 21 fitting in an indent on the underside of a surface preferably at a point on said surface where all four telescoping posts are unweighted equally and where the upward force of the gas spring is not over powered as to cause upward movement of said surface. Because the locks prevent only downward movement of the telescoping tubes the only upward movement of the surface would be provided by the user lifting up; thus, the more economical one way locks can be used. Because gas spring is non-permanently situated, pivoting the top to different equilibrium locations can be achieved to compensate for different loads typically placed on top of the surface.

What is claimed is:

1. An adjustable table support system comprising: two seperate vertical support units where each unit consists of; a pair of telescopic post members as a means of changing front and/or rear height of an attached surface where telescopic members are attached permanently apart in parallel to each other by cross-bracing members; one or more cross-axle members as a means of linking both vertical support units apart and in parallel to each other where said members are attached laterally across to opposite points of cross-bracing members of each respective vertical support unit; a friction locking device affixed at a point where a smaller diameter moving telescopic posts enters a larger diameter non-moving telescopic post of each telescopic member as a means of preventing downward movement of the moving telescopic post; a central bracing member affixed on cross-bracing members and extending vertically between telescopic members to a point above locking devices; a rocker plate rotationally affixed on top of said central bracing member; a friction lock linking member extending across to link to an actuating leverage appendage on each friction locking device as a means for tandem actuation; a lifting member pivotally attached on a central point of the friction lock linking member extending upward pivotally connecting on a leverage point of the rocker plate as a means of , converting a rotational force of said plate to an up and down force on the friction lock linking members; a common actuating lever extending laterally across to a leverage point on the rocker plate on each vertical support unit as a means of tandemly linking with one lever a movement of all four friction locking devices; a pair of cross-connecting members, each laterally tops of respective front and rear pair of telescoping members providing for a common member for attachment to underside of a surface; a rotating connecting device connecting cross-connecting members at right angles to the telescopic moving posts allowing said posts and cross-connecting members to rotate independently of each other for surface angle changes; a sliding device ultimately connecting to at least one cross-connecting member and an attached surface to allow lateral movement between the two; an enclosure partially encasing each aforementioned vertical support unit; a means for counter-balancing the weight of an attached surface.

2. A manually adjustable table support system as described in claim 1 where the friction lock linking member consists of two spring-loaded pins sliding within and protruding from ends of a hollow supporting tube extending along an axis between and guiding said pins to link with a leverage appendage of each friction locking device.

3. A manually adjustable table support system as described in claim 1 where the lifting member is of turnbuckle design where the length can be adjusted by turning insertions threaded into opposite ends of an elongated body.

4. A manually adjustable table support system as described in claim 1 where the rotating connecting device is a "T" connection thru which the cross connecting member can extend into and rotate within the cross of the "T" and where the stem of the "T" provides secure attachment for the moving telescopic post top.

5. A manually adjustable table support system as described in claim 1 where the enclosure is a shell which has apertures along the same axis as the spring loaded pins of the friction lock linking members as to provide for exit and alignment of said pins to link with the leverage appendage on the friction locking device.

6. A manually adjustable table support system as described in claim 1 where the cross-axle members are non-permanently affixed whereby ends of cross axle-members slide into sleeve members of slightly larger size which are affixed to cross-bracing members.

7. A manually adjustable table support system as described in claim 1 where the common actuating lever pivots with or on the same axle as the rocker plate.

8. A manually adjustable table support system as described in claim 1 where both stationary and moving friction device members are of a sleeve configuration which surrounds a moving telescopic member where said moving sleeve having a means for wedging, slides within and between stationary member and aforesaid telescopic member.

9. A manually adjustable table support system as described in claim 1 where the sliding device consists of a sliding member affixed to the cross-connecting member where said sliding member moves on or within a guiding member which provides a means of attachment to the underside of a surface.

10. A manually adjustable table support system as described in claim 9 where the sliding member is a rectangular plate and the guiding member is a channel-shaped track.

* * * * *